US006257183B1

(12) United States Patent
Vorih et al.

(10) Patent No.: US 6,257,183 B1
(45) Date of Patent: Jul. 10, 2001

(54) LOST MOTION FULL AUTHORITY VALVE ACTUATION SYSTEM

(75) Inventors: Joseph M. Vorih, West Suffield, CT (US); Mark A. Israel, Amherst, MA (US)

(73) Assignee: Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 09/185,585

(22) Filed: Nov. 4, 1998

Related U.S. Application Data

(60) Provisional application No. 60/066,376, filed on Nov. 21, 1997, and provisional application No. 60/064,353, filed on Nov. 4, 1997.

(51) Int. Cl.[7] ..... F01L 9/02

(52) U.S. Cl. ..... 123/90.12; 123/90.15

(58) Field of Search ..... 123/90.12, 90.15, 123/90.16, 90.39, 321

(56) References Cited

U.S. PATENT DOCUMENTS

| | | | |
|---|---|---|---|
| 3,179,094 | 4/1965 | Ribeton . | |
| 4,497,307 | 2/1985 | Paar et al. . | |
| 4,615,306 | 10/1986 | Wakeman . | |
| 4,644,914 | 2/1987 | Morita et al. . | |
| 4,887,562 | 12/1989 | Wakeman . | |
| 4,930,465 | 6/1990 | Wakeman et al. . | |
| 5,158,048 | 10/1992 | Robnett et al. . | |
| 5,216,988 | 6/1993 | Taxon . | |
| 5,233,951 | 8/1993 | Hausknecht . | |
| 5,255,641 | 10/1993 | Schechter . | |
| 5,485,813 | 1/1996 | Molitor et al. . | |
| 5,499,606 | 3/1996 | Robnett et al. . | |
| 5,503,120 | 4/1996 | Shirey et al. . | |
| 5,537,976 | 7/1996 | Hu . | |
| 5,546,914 * | 8/1996 | Scheinert | 123/569 |
| 5,619,965 | 4/1997 | Cosma et al. . | |
| 5,680,841 | 10/1997 | Hu . | |
| 5,787,859 * | 8/1998 | Meistrick et al. | 123/321 |
| 5,829,397 | 11/1998 | Vorih et al. . | |
| 5,839,453 | 11/1998 | Hu . | |

FOREIGN PATENT DOCUMENTS

3815668 A1 11/1989 (DE) .

* cited by examiner

*Primary Examiner*—Noah P. Kamen
*Assistant Examiner*—Hai Huynh
(74) *Attorney, Agent, or Firm*—Collier Shannon Scott, PLLC

(57) ABSTRACT

A lost motion variable valve actuation system utilizing a single solenoid valve or trigger valve to vary the timing of the intake and exhaust valves for a cylinder of an internal combustion engine. The solenoid controls the oil supply to the tappets, which in turn, determine valve motion in response to a camshaft lobe The system allows independent control of each valve and provides for advanced features such as enhanced intake air swirl, two-valve or four-valve operation and staggered valve opening. The invention provides for valve operation even in the event of a total loss of system hydraulic pressure. The invention provides the practical benefits of a fully-variable system while preserving the security and reliability of a mechanical, cam-driven valve train. The invention provides for filling the exhaust and intake tappets independently without connecting their respective hydraulic circuits.

22 Claims, 5 Drawing Sheets

LOST MOTION FULL AUTHORITY VALVE ACTUATION SYSTEM

CROSS REFERENCE TO RELATED APPLICATIONS

This application claims priority to U.S. Provisional Applications Serial No. 60/066,376, entitled "LOST MOTION SYSTEM FOR INDEPENDENT CONTROL OF MULTIPLE ENGINE VALVES," filed on Nov. 21, 1997 and Serial No. 60/064,353, "FAIL SAFE LOST MOTION FULL AUTHORITY VALVE ACTUATION SYSTEM" filed on Nov. 4, 1997.

FIELD OF THE INVENTION

The present invention relates to engine valve actuation systems for internal combustion engines. More particularly, the invention is directed to a lost motion valve actuation system.

BACKGROUND OF THE INVENTION

Engine cylinder chamber valves are typically poppet type valves. These poppet type engine valves are normally biased closed by a valve spring. The valves open when sufficient force is applied to overcome the spring force. There are many different methods of generating valve opening force. Many valve actuation systems utilize hydraulic pressure. These systems typically include a master and slave piston arrangement The slave piston contacts the valve stem of the engine valve. Motion of the master piston generates an increase in hydraulic pressure on the slave piston. In response to the increased hydraulic pressure, the slave piston moves forcing the engine valve open.

The master and slave pistons are hydraulically linked. In such systems, a rotating cam typically causes the displacement of the master piston. The motion of the master piston is transferred to the slave piston by means of the hydraulic link between the two pistons. The motion of the slave piston, relative to the cam profile, may be modified by draining and filling the hydraulic link between the master and slave pistons. This process provides for transferring selected portions of the master piston's motion, i.e. the cam profile, to the slave piston. A system capable of transferring only a portion of the motion is commonly called a "lost motion" system. An example of such a system is described in Hu, U.S. Pat. No. 5,537,976, assigned to the assignee of the present application and incorporated herein by reference.

Lost motion systems may be used to vary engine valve timing. In order to achieve enhanced internal combustion engine performance and fuel economy, it may be necessary to vary the timing of the engines intake and exhaust events. It may be desirable in engines having multiple intake and/or exhaust valves per cylinder to effect staggered opening among the valves in a cylinder. It also may be desired to operate a four valve cylinder in either a two valve or four valve mode. Additionally, it may be necessary to "cut-out" the cylinder. Cylinder cut-out can be achieved by failing to actuate all of one cylinders, intake, and exhaust valves. A valve actuation system which is capable of varying the cylinder operation from all valve operation to cylinder cut-out is termed a fully variable system. Fully variable valve actuation systems are also known as "full authority" systems.

As discussed above, the typical valve actuation system utilizes a cam to impart motion to a master piston. However, recent efforts to achieve variable control over intake and exhaust valve events have focused on camless engine designs. An example of a camless engine is disclosed in U.S. Pat. No. 5,619,965, which is incorporated herein by reference. Camless engine designs have proved to be difficult and expensive to implement. A further disadvantage of many camless designs is the lack of any mechanical backup. The failure of electric power or loss of hydraulic pressure may result in no valve motion at all. In fact, even some cam-driven designs cannot produce valve motion in the event of a loss of hydraulic pressure. These systems lack a fail-safe operating mode.

There is a need for a lost motion variable valve actuation system which provides control of an engine cylinder's intake and an exhaust valve using a common trigger valve. Current valve actuation systems typically rely on a single trigger valve for each engine valve. The few systems which utilize a single solenoid to control multiple engine valves, do not have the capability to independently control the positions of the valves. There is also a need for a valve actuation system which has the practical benefits of a fully variable system with the security and reliability of a mechanical, cam-driven valve train, and with the advanced system features commonly available in camless engine designs.

The present invention provides a means for controlling the engine valves in an internal combustion engine cylinder having multiple intake and/or exhaust valves utilizing a novel electro-hydraulic valve actuation system. By pairing an intake and exhaust valve under the control of a single hydraulic solenoid, or trigger, valve, independent control of each valve may be obtained, allowing for such features as enhanced intake air swirl, two-valve operation over a certain speed range, and staggered valve opening. This is possible since in most cases, relevant intake and exhaust events occur at different times in a four-cycle engine. Thus, at any given time, only one of the two valves in a set (either the intake or the exhaust) is active, with the other at base circle. Opening the trigger valve at such time would only affect the valve driven by the cam lobe off base circle at that instant. Events which overlap significantly, but which need independent control, can be placed on different cams (i.e., on one of two exhaust cams in a dual-overhead cam system with discrete lobes for each valve).

OBJECTS OF THE INVENTION

It is therefore an object of the present invention to provide innovative and economical variable timing valve actuation design.

It is a further object of the present invention to provide a fail-safe operating mode for a valve actuation system.

It is also an object of the present invention to provide common control of both intake and exhaust valve actuation circuits in a cylinder with one high-speed trigger valve.

It is also an object of the present invention to provide enhanced reliability through an innovative yet simple design of a variable timing engine valve actuation system.

It is another object of the present invention to provide independent control of each pair of intake and exhaust valves.

It is also an object of the present invention to provide a valve actuation system capable of cylinder cut-out.

It is another object of the present invention to provide selectable valve operation for each cylinder.

It is another object of the present invention to provide staggered opening of either intake or exhaust valves.

It is also an object of the present invention to provide a full-authority valve actuation system for an internal combustion engine.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenges, applicants have developed an innovative, economical method and apparatus for controlling engine valve operation in an internal combustion engine. The present invention is directed to a valve actuation system for a cylinder of an internal combustion engine having an intake and an exhaust valve comprising: an intake valve train; an exhaust valve train; an intake valve hydraulic actuator that selectively responds to motion of the intake valve train and causes the intake valve to open; an exhaust valve hydraulic actuator that selectively responds to motion of the exhaust valve train and causes the exhaust valve to open; a control valve for controlling the supply of hydraulic fluid to the intake valve actuator and the exhaust valve actuator to control the response of the actuators to the motion of the valve trains. The hydraulic actuators may include a master piston; a slave piston; and a variable volume fluid chamber formed between the master and slave piston. The control valve may be a solenoid actuated valve or a spool valve. The actuators may be oriented so that the slave piston contacts the engine valve and the master piston contacts the valve train. However, the master piston may contact the engine valve and the slave piston may contact the valve train.

The control valve controls the amount of fluid in the variable volume fluid chamber in order to selectively modify the openings of the exhaust valve in response to the exhaust valve train. The exhaust valve train may include a rocker arm. The actuators may also comprise hydraulic tappets. The tappets may include master and slave pistons, wherein the master piston includes a central bore and the slave piston is slidably disposed inside of the central bore. The system may also include a means for effectuating engine valve motion upon a loss of hydraulic pressure. The means for effectuating engine valve motion may comprise the mechanical link created when the variable volume chamber completely collapses the master piston contacts the slave piston directly in order to transfer motion from the valve train to the valve.

An alternative embodiment of the present invention is a valve actuation system for a cylinder of an internal combustion engine having a plurality of engine valves comprising: a plurality of valve trams; wherein each valve train moves to open one of the plurality of engine valves; a plurality of hydraulic actuators, wherein each hydraulic actuator selectively responds to motion of one of the valve trains to open one of the engine valves; and a means for controlling the supply of fluid to each pair of hydraulic actuators. Each hydraulic actuator may comprise: a master piston; a slave piston; and a variable volume fluid chamber formed between the master and slave piston. The means for controlling the supply of fluid may comprise a solenoid actuated valve. The means for controlling, controls the supply of fluid to a hydraulic actuator for an intake valve and an exhaust valve. The system also may include a means for effectuating engine valve motion upon a loss of hydraulic pressure. The means for effectuating engine valve motion may comprise a mechanical link created when the variable volume chamber completely collapses causing the master piston to contact the slave piston directly transferring motion directly from the valve train to the engine valve.

A further embodiment of the present invention may be a valve actuation system for an internal combustion engine having at least one engine valve operable to control flow into or out of a cylinder, the valve actuation system comprising: a rocker lever pivotally mounted adjacent the engine valve for opening the engine valve, wherein the rocker lever includes a first and second end, a fluid passage, and a bore at the first end of the rocker lever, wherein the fluid passage connects the bore to a fluid supply source; an actuator piston slidably disposed within the bore; a means for pivoting the rocker lever; and a means for controlling the pressure in the fluid passage. The means for controlling the pressure may be a control valve. The means for pivoting may comprise a rotating cam. The first end of the rocker may be displaced by the means for pivoting. The second end of the rocker may displace the engine valve. The actuator piston may be forced out of the bore by increased fluid pressure in the fluid passage, and the amount of engine valve lift is proportional to the pressure in the fluid passage. The system provides that upon a loss of pressure in the passage, the means for pivoting causes the rocker lever to pivot and some amount of engine valve lift will still occur.

A further embodiment of the present invention may be an engine valve actuation system for a cylinder of an internal combustion engine that includes two intake and two exhaust valves comprising: an intake valve train, an exhaust valve train; a first intake valve actuator that selectively responds to motion of the intake valve train and causes the first intake valve to open; a second intake valve actuator that selectively responds to motion of the intake valve train and causes the second intake valve to open; a first exhaust valve actuator that selectively responds to motion of the exhaust valve train and causes the first exhaust valve to open; a second exhaust valve actuator that selectively responds to motion of the exhaust valve train and causes the second exhaust valve to open; a first control valve for controlling the operation of the first intake and the first exhaust valve actuators; and a second control valve for controlling the operation of the second intake and the second exhaust valve actuators. The control valves may be solenoid valves. The valve actuators may be hydraulic tappets that comprise: a slave piston; a master piston that includes a central bore; and wherein the slave piston is slidably disposed within the central bore forming a variable volume chamber between the master and slave piston.

It is to be understood that both the foregoing general description and the following detailed description are exemplary and explanatory only and are not restrictive of the invention as claimed. The accompanying drawings, which are incorporated herein by reference, and which constitute a part of this specification, illustrate certain embodiments of the invention, and together with the detailed description serve to explain the principles of the present invention.

DETAILED DESCRIPTION OF A PREFERRED EMBODIMENT

Figure 1:
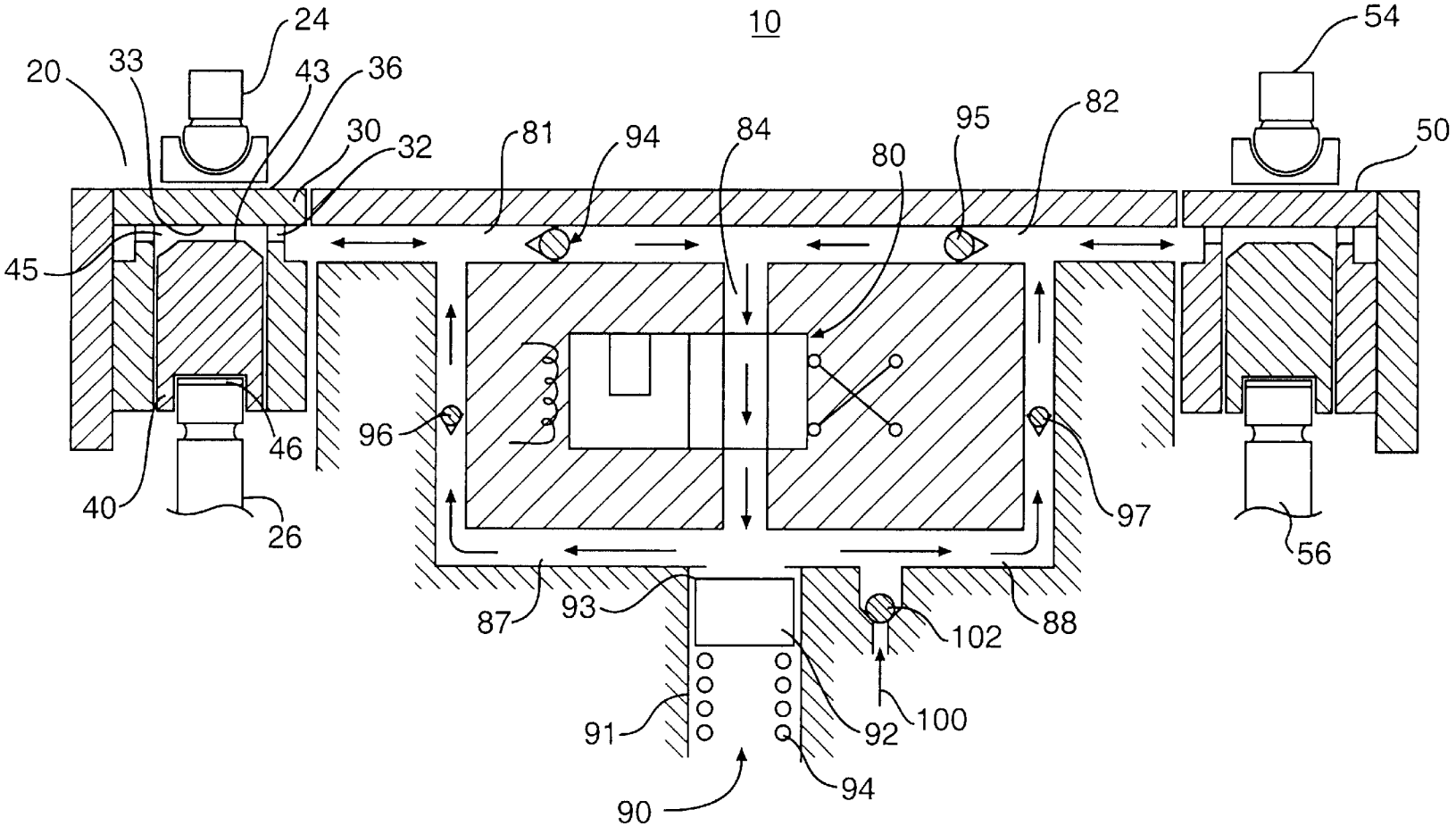
FIG. 1 is a schematic view of a valve actuation system wherein an engine cylinder's intake and exhaust valve actuators are controlled by a common solenoid valve.

Referring now to FIG. 1, which discloses a valve actuation system 10 according to the present invention.

The valve actuation system 10 of the present invention comprises an intake tappet 20, an exhaust tappet 50, and a trigger valve 80. The system 10 may further comprise other elements such as: an oil supply 100 and an accumulator 90. The valve actuating system 10 of the present invention is a lost motion system for actuating an internal combustion engine cylinder's intake valve 26 and an exhaust valve 56.

Intake tappet 20 and exhaust tappet 50 are hydraulic actuators that may be similar and may comprise a master piston 30 and a slave piston 40. Master piston 30 comprises a hollow, cylindrical element which includes top surface 36, internal endwall 33 and an orifice 32. Slave piston 40 comprises endwall 43 and bottom surface 46. Slave piston 40 preferably comprises a cylindrical body appropriately sized for positioning within master piston 30. Together, slave piston 40 and master piston 30 define a chamber 45. The volume of chamber 45 may vary according to the position of the pistons relative to one another. An orifice 32 is provided in the master piston 30 to allow oil flow into and out of chamber 45.

Tappets 20 and 50 may be actuated by external valve trains that move to contact the tappets and actuate the engine valves 26 and 56. Elements of the valve trains 24 and 54 contact the top surface 36 of the master piston 30, while bottom surface 46 of slave piston 40 contacts the appropriate engine valve. Valve train elements 24 and 54 are located external to the system 10. The valve trains are preferably driven by a rotating cam (not shown). The valve trains may comprise, for example, a rocker arm or a hydraulic linkage. The valve trains may include a master and slave piston arrangement wherein the master piston is displaced by a cam follower and the motion of the master piston is hydraulically transferred to a slave piston, that serves as either of valve train elements 24 and 54. The valve trains may also comprise a common rail system where the valve train elements are displaced by fluid supplied from a pressurized header. The tappets 20 and 50 function as a means for transferring motion of the valve train elements 24 and 54 to the appropriate engine valves.

The position of the valves 26, 56 may vary relative to the tappets 20, 50. For example, the role of the master and slave pistons, described above, may be reversed so that the master piston 30 contacts the engine valve and the slave piston 40 contacts the valve train.

The present invention includes a trigger valve 80. Trigger valve 80 is typically a high speed solenoid-actuated hydraulic control valve. Trigger valve 80 comprises an inlet 84 and an outlet 86. Inlet 84 is hydraulically connected to the intake tappet 20 via passageway 81, and to exhaust tappet 50 via passageway 82. Outlet 86 is hydraulically connected to the intake tappet 20 via passageway 87, and to exhaust tappet 50 by means of passageway 88. Outlet 86 is also hydraulically connected to accumulator 90 and to oil supply check valve 102.

Accumulator 90 comprises piston 92, spring 94, and variable volume chamber 93. Accumulator 90 is directly hydraulically connected to outlet 86 of trigger valve 80, as well as passageways 87 and 88. Spring 94 comprises a biasing means for urging piston 92 in a direction to decrease the size of chamber 93. Accumulator 90 provides a surge volume and a source of make-up oil and pressure to the system 10.

Check valve 98 is disposed in passageway 81 between intake tappet 20 and inlet 84, while check valve 96 is disposed in passageway 87 between intake tappet 20 and outlet 86. Similarly, check valve 95 is disposed in passageway 82 between exhaust tappet 50 and inlet 84, while check valve 97 is disposed in passageway 88 between exhaust tappet 50 and outlet 86 to trigger valve 80. Check valves 98 and 95 permit oil to flow from the tappets 20, 50 to the trigger valve 80. Check valves 96 and 97 permit supply oil to flow to the tappets 20, 50. The location of the aforementioned check valves allow the tappets to fill and drain as required. The check valves also prevent cross-talk between the tappets.

Oil supply 100 preferably comprises a direct feed from the internal combustion engine lube oil system, but oil supply 100 may also comprise any suitable source of hydraulic fluid, such as an independent pressurized oil system. Check valve 102 serves to isolate the system 10 from oil supply 100.

The operation of the invention is now described with further reference to FIG. 1. Focusing on intake tappet 20, during normal operation chamber 45 is filled with oil from supply 100 through passageway 87 and orifice 32. Trigger valve 80 is closed, and oil in chamber 45 maintains a constant volume since check valves 95 and 96, as well as trigger valve 80, prevent the escape of oil from chamber 45. In this "solid" condition, all cam motion imparted to intake valve train element 24 is hydro-mechanically transferred to intake valve 26 through the combined action of the master piston 30, the oil in chamber 45, and the slave piston 40.

When "lost motion" is desired, i.e., that a portion of the motion of intake valve train element 24 is not to be transferred to intake valve 26, a control system (not shown) energizes trigger valve 80. Trigger valve 80 opens, and a hydraulic flow path is established from chamber 45 to the accumulator 90. The loss of oil from chamber 45 causes the volume of the chamber to shrink, decreasing the combined length of intake master piston 30 and intake slave piston 40. A portion of the motion of intake valve train element 24 is thus absorbed before it reaches intake valve 26.

When lost motion is no longer desired, trigger valve 80 de-energizes allowing make-up oil from accumulator 90 and oil supply 100 to flow through passageway 87 into chamber 45 to expand the chamber to its maximum volume. The tappet 20 is now solid, and the entire motion of the intake valve train is transferred to the intake valve 26.

The operation of exhaust tappet 50 is similar to that described above for the intake tappet 20. However, the intake and exhaust events occur at different times in an internal combustion engine cycle. There is no significant period in which the intake valve cam which imparts motion to intake valve train element 24 and the exhaust cam which imparts motion to exhaust valve train element 54 are both active. At any given time, one is active, while the other cam is at or close to base circle. As a result, when trigger valve 80 is opened, only the valve driven by the cam lobe off base circle at that instant is affected.

Figure 6:
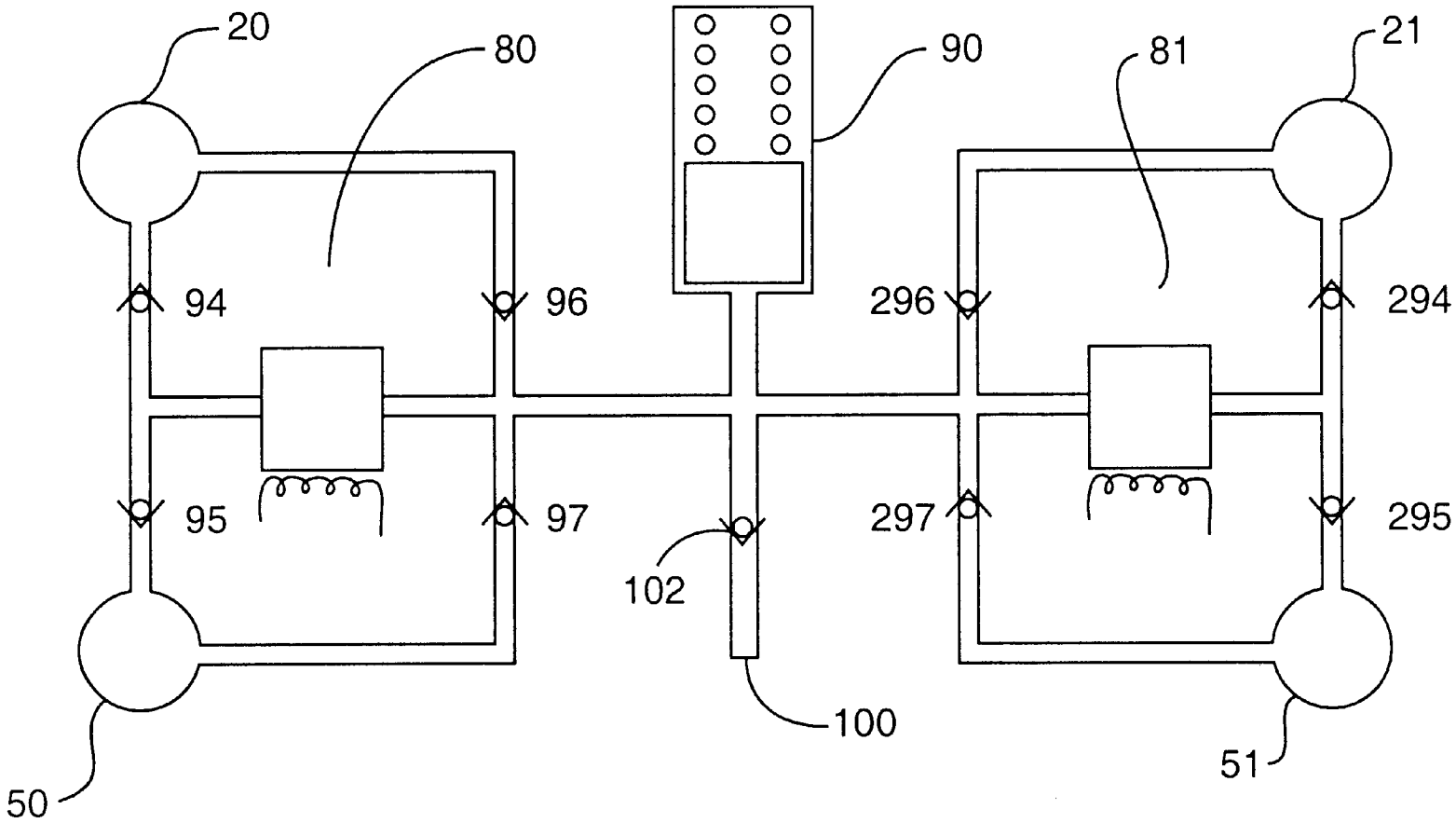
FIG. 6 is a schematic view of a variable valve actuation system for a four valve cylinder of an internal combustion engine.

The design of the present invention thus enables independent control of intake valve 26 and exhaust valve 56 using only one solenoid valve 80. As shown in FIG. 6, two trigger valves 80 and 81 may be provided to control four engine valves (two intake valves and two exhaust valves) located in one cylinder. FIG. 6 discloses a system with two intake valve actuators 20 and 21, two exhaust valve actuators 50 and 51, an accumulator 90, and various check valves 95–98 and 294–297 that operate as shown in FIG. 1 and described above.

Each trigger valve is connected to two tappets—one exhaust and one intake. The configuration shown in FIG. 6 allows for each intake and exhaust valve to operate independently as discussed above. The trigger valves may be operated to allow any one or more of the engine valves to be shut off at any given time. The invention allows for full cylinder cut-out. The configuration shown in FIG. 6 allows such features as enhanced intake air swirl, two-valve operation over a certain speed range, and staggered valve opening to be provided. The operation of the trigger valves 80 and 81 may be staggered to provide for any combination of engine valve operation. For example, one exhaust and one intake valve may be operated. Alternatively, one intake and two exhaust valves may be operated. In another mode, one exhaust valve and two intake valves may be operated together. The invention provides for the operation of all or none of the engine valves or any combination therebetween. In addition, the trigger valves 80 and 81 may operate to provide for lost motion at each actuator.

Figure 2:
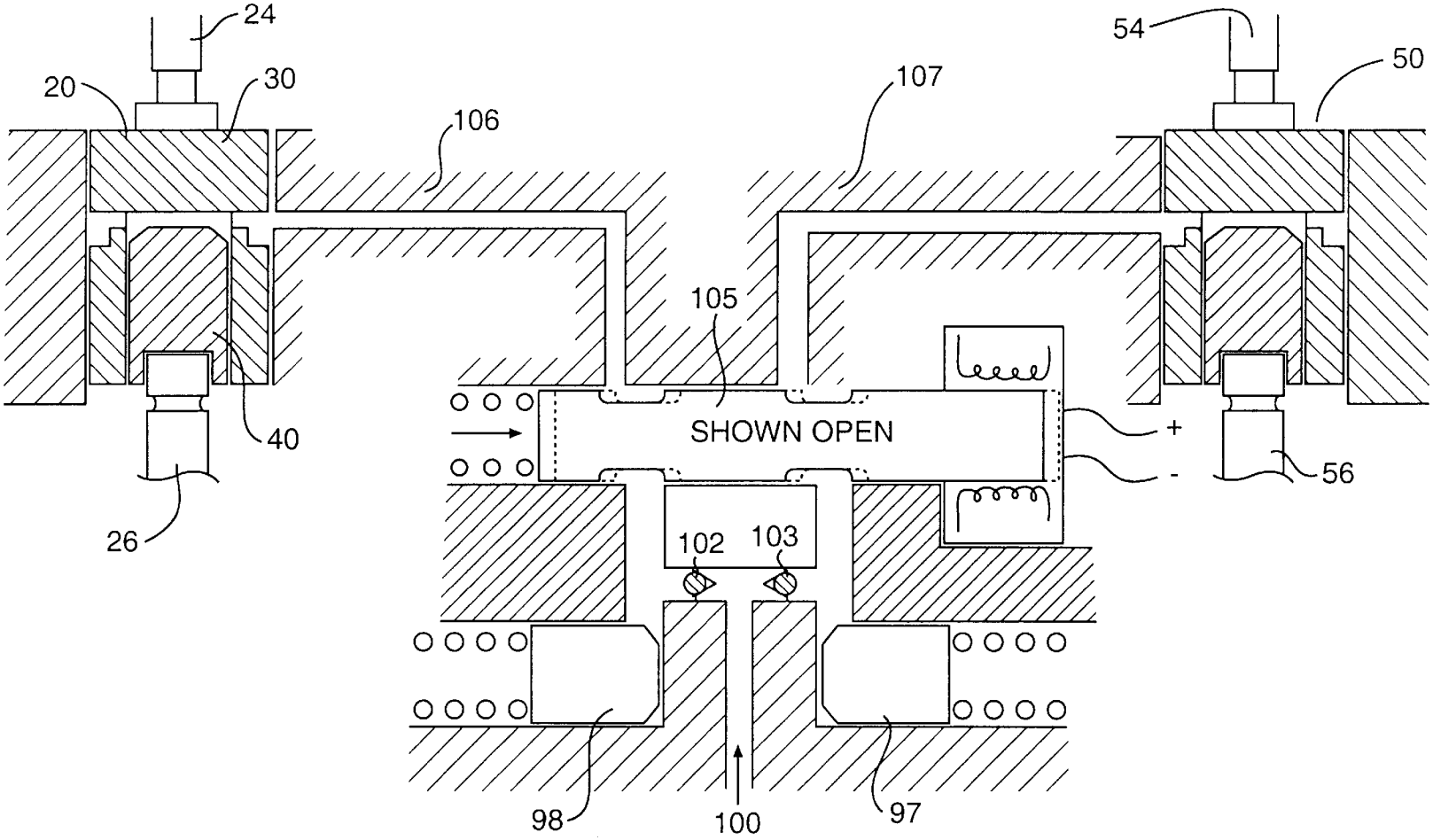
FIG. 2 is a schematic view of a variable valve actuation system wherein an engine cylinder's intake and exhaust valves are controlled by a common control valve.

Referring now to FIG. 2, in an alternate embodiment of the invention, trigger valve 80 is replaced by solenoid actuated spool valve 105. In this embodiment of the invention, a separate intake hydraulic circuit 106 and exhaust hydraulic circuit 107 are provided. The circuits are independent of each other except for a common source of supply oil 100. Check valves 102 and 103 isolate the circuits from each other while permitting fluid from oil supply 100 to flow to either circuit. Intake circuit 120 is provided with accumulator 198, while exhaust circuit 150 is provided with accumulator 197.

The operation of the embodiment of the invention shown in FIG. 2 is similar to that of the embodiment shown in FIG. 1 and described above. When spool valve 105 is in the open position, a flow path is established from intake tappet 20 to accumulator 198, and from exhaust tappet 50 to accumulator 197. When spool valve 105 is in the open position, oil may flow out of intake tappet 20 and out of exhaust tappet 50 to achieve variable valve actuation of intake valve 26 and exhaust valve 56. When spool valve 105 is in the closed position, intake tappet 20 and exhaust tappet 50 are "solid," so that full cam-driven motion of intake valve 26 and exhaust valve 56 occurs. As described above, accumulators 197 and 198 provide surge and make-up volumes for intake circuit 120 and exhaust circuit 150, respectively.

Referring again to FIG. 1, an additional embodiment of the invention which provides for fail-safe valve operation in the event of the failure of electric power or hydraulic pressure may be described. A mechanical link is created between the valve train and the engine valve. Intake master piston 30 and intake slave piston 40, and intake valve train element 24 and intake valve 26 are designed so that upon a loss of system oil pressure for any reason, endwall 33 of intake master piston 30 will contact endwall 43 of intake slave piston 40 to impart at least a portion of the motion of intake valve train element 24 to intake valve 26. Some intake valve motion will occur even upon a total loss of system oil pressure. Exhaust tappet 50 may be similarly constructed. The system disclosed in FIG. 6 may also provide for fail safe operation upon loss of hydraulic pressure.

This embodiment of the invention provides both variable timing benefits of lost motion system, with the reliability of a purely mechanical, non-hydraulic cam-driven valve actuation system. Various internal configurations of the master and slave piston within a tappet may be employed so long as when oil pressure is lost and the tappet is collapsed the master and slave piston contact in a manner to ensure transfer of cam motion through the tappet to the respective engine valve. This embodiment of the invention may also employ a spool valve as shown in FIG. 2.

Figure 3:
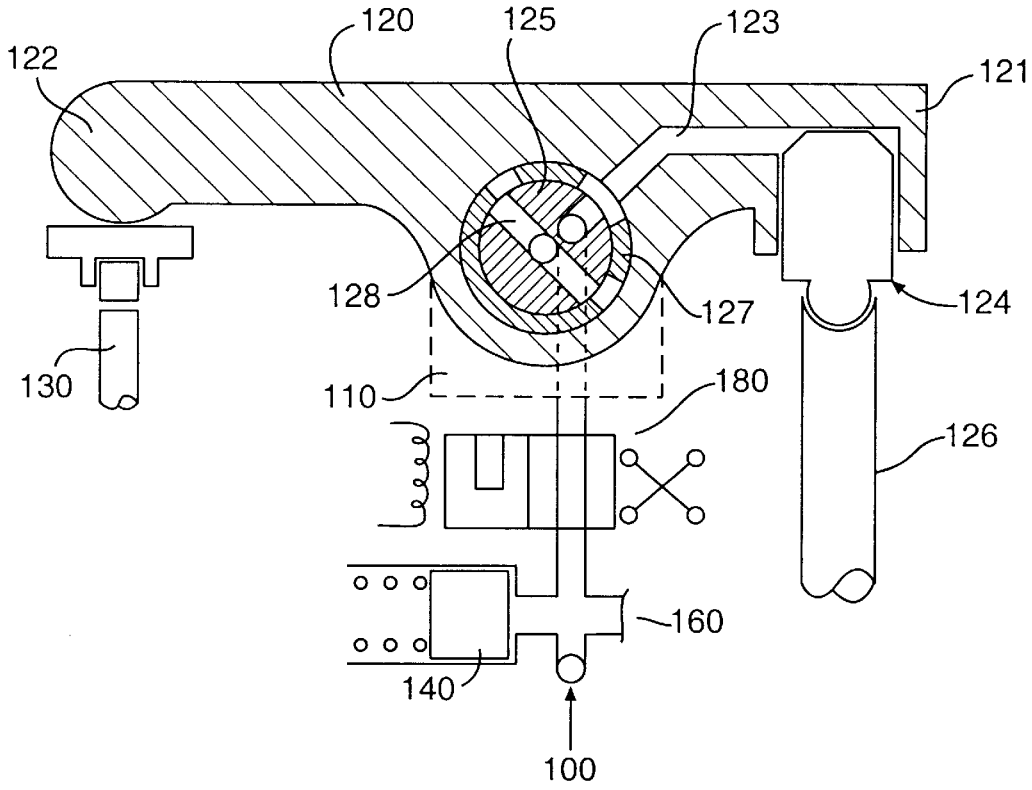
FIG. 3 is a cross-sectional schematic side view of the variable valve actuation system disclosed in FIG. 4.

FIG. 3 discloses an alternative embodiment of a valve actuation system according to the present invention. The valve actuation system shown in FIG. 3 comprises an intake valve rocker lever 120, a solenoid actuated trigger valve 180. The system may further comprise a rocker pedestal 110 and an accumulator 140. FIG. 3 is a cross-sectional view of the intake valve rocker lever 120. An exhaust valve rocker lever may be similarly configured.

As shown in FIG. 3, intake rocker lever 120 has first end 121 and a second end 122. The rocker lever further includes a fluid circuit 123 and an actuator piston 124. The pressure in the fluid circuit 123 is controlled so as to selectively place the system in the valve actuation mode. Intake rocker lever 120 further includes an opening for rocker lever shaft 125, on which the rocker lever pivots in response to the lift profile of the appropriate engine valve cam lobe. Rocker lever pivoting is initiated by the rise and fall of push tube 126. Push tube 126 rises and falls in response to cam lobe motion, causing the rocker lever 120 to pivot in response to cam motion. A bearing in the form of a cylindrical bushing 127 is positioned around shaft 125 and is rigidly connected to rocker lever 120 so as to permit smooth pivotal rotation on shaft 125. Lubricating oil is supplied to bearing 127 through passage 128.

The operation of the valve actuation system shown in FIG. 3 will now be described. When trigger valve 180 is open fluid circuit 123 may be filled by fluid from supply 100. Actuator piston 124 is slidably displaced downward contacting push tube 126. When no valve operation is desired, trigger valve 180 is maintained open. When push tube 126 rises in response to cam motion, fluid above the actuator piston 124 moves through fluid circuit 123 and the trigger valve 180 and into accumulator 140. Rocker arm 120 does not move in response to cam motion. When valve operation is desired, trigger valve 180 is shut. Actuator piston 124 may not move upward since the fluid in circuit 123 may not escape. When push tube 126 is displaced by the cam lobe the intake rocker lever 120 pivots about rocker shaft 125 in response to the intake cam lobe lift profile. As the first end 121 of the rocker lever 120 is displaced upward by push tube 126, the rocker lever 120 pivots forcing second end 122 downward. As second end 122 moves downward it contacts intake valve 130 forcing the valve open. When valve operation is no longer desired, trigger valve 180 opens allowing the accumulator 140 to absorb motion of the push tube 126.

The system shown in FIG. 3 may be connected to additional engine valves by fluid supply header 160. Multiple engine valve actuation systems may utilize the same fluid supply 100 and accumulator 140. It is also within the scope of the present invention to arrange the valve actuation system so that a push tube or cam follower contacts the rocker directly and an actuator piston contacts the engine valve.

Figure 4:
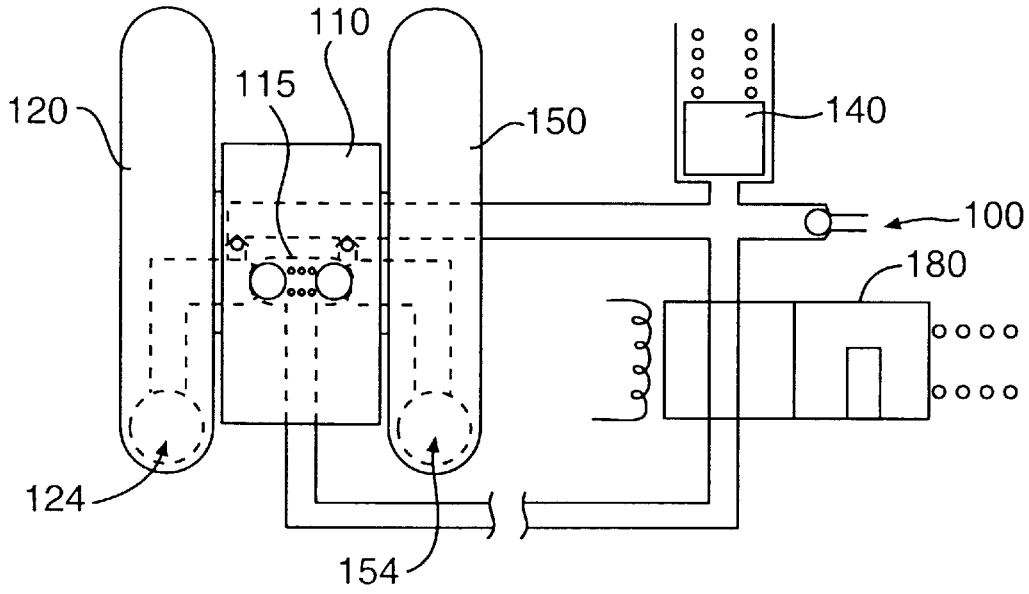
FIG. 4 is a top schematic view of a variable valve actuation system integrated within a rocker arm with a single solenoid valve for two engine valves.

FIG. 4 discloses an alternative view of the system shown in FIG. 3, however the valve actuation system of FIG. 4 allows for the control of two engine valves with a single trigger valve. The system disclosed in FIG. 4 comprises an intake rocker 120 and an exhaust rocker 150. The rockers are mounted in rocker pedestal 110. The rockers include actuator pistons 124 and 154, which function as described above. The system of FIG. 4 further includes a pair of check valves 115 located between the rockers. The system of FIG. 4 may further include separate check valves 111 and 112 located between the fluid supply 100 and the valve actuators.

When engine valve operation is desired, trigger valve 180 is shut creating a hydraulic link between the push tubes and the engine valves. While trigger valve 180 is shut, fluid may not escape from above the actuator and push tube motion is transferred to the engine valve in the manner described above for the system disclosed in FIG. 3. When valve operation is no longer desired, trigger valve 180 is opened allowing the fluid pressure created by the upward motion of the actuator piston to be absorbed by the accumulator 140.

Figure 5:
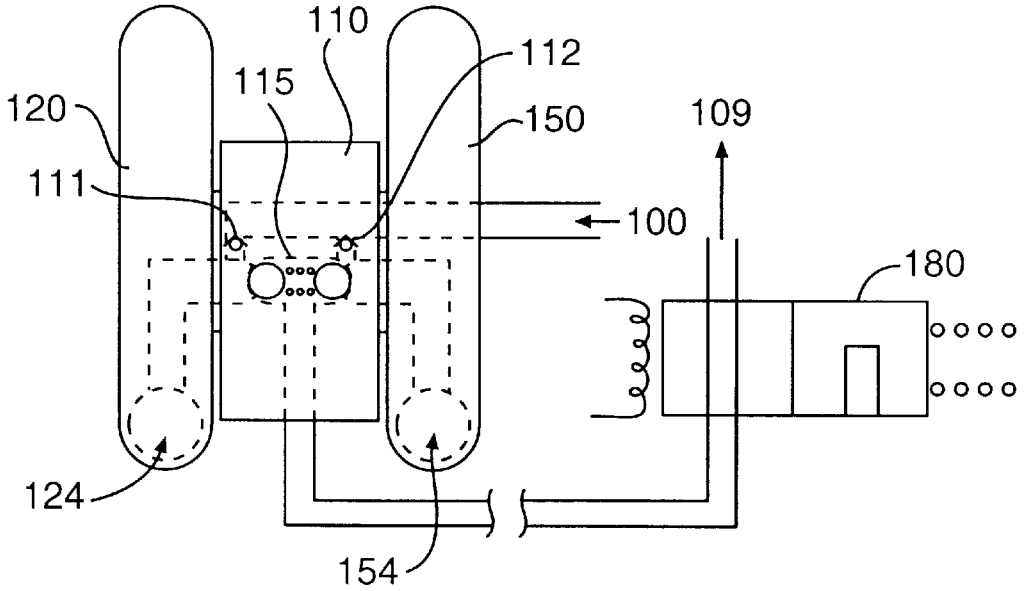
FIG. 5 is a top schematic view of an alternative embodiment of the system shown in FIG. 4, without an accumulator.

FIG. 5 discloses a system similar to that shown in FIG. 4. The system disclosed in FIG. 5 does not include an accumulator. Instead, when the actuator pistons move upward the fluid is forced out the drain 109.

The systems disclosed in FIGS. 3, 4 and 5 all may include a method of providing for valve operation in the even of a total loss of pressure within circuit 123. Referring to FIG. 3, for example, the system may be designed so that the total upward travel of push tube 126 exceeds the available travel distance of actuator piston 124 within bore 129. If no pressure exists in circuit 123, actuator piston 124 will be forced upward within bore 129 by the rising push tube 126. Once actuator piston 124 has reached its mechanical stop continued upward movement of push tube 126 will cause the first end 121 of rocker lever 120 to move upward pivoting the rocker lever and causing the second end 122 to move downward opening the engine valve. Thus a fail safe mechanical method for opening the engine valves may be provided.

It will be apparent to those skilled in the art that various modifications and variations can be made in the construction and configuration of the present invention without departing from the scope or spirit of the invention. Various modifications and variations can be made in the construction of intake tappet 20 and exhaust tappet 50 without departing from the scope or spirit of the invention. For example, the master and slave pistons may be of a variety of sizes and cross-sectional shapes as long as these elements mate to form a functioning tappet. The tappets may be concentric, axially mounted, etc. Any means capable of imparting mechanical motion to the tappets may be employed and still be within the scope of the invention. Further, it may be appropriate to make additional modifications, such as including different arrangements of valve rockers, push tubes, etc., to form the valve actuation train on either side of the tappet. Thus, it is intended that the present invention cover the modifications and variations of the invention provided they come within the scope of the appended claims and their equivalent.

What is claimed is:

1. A valve actuation system for a cylinder of an internal combustion engine, the cylinder having an intake valve and an exhaust valve, said valve actuation system comprising:

an intake valve train for providing motion to operate the intake valve;

an exhaust valve train for providing motion to operate the exhaust valve;

an intake valve hydraulic actuator that selectively responds to motion of said intake valve train and causes the intake valve to open;

an exhaust valve hydraulic actuator that selectively responds to motion of said exhaust valve train and causes the exhaust valve to open;

a control valve for controlling the supply of hydraulic fluid of said intake valve hydraulic actuator and said exhaust valve hydraulic actuator to control the operation of said intake valve hydraulic actuator and said exhaust valve hydraulic actuator in response to the motion of said intake valve train and said exhaust valve train; and wherein the intake valve hydraulic actuator comprises a first master piston, a first slave piston, and a first variable volume fluid chamber formed between said first master and slave pistons; and the exhaust valve hydraulic actuator comprises a second master piston, a second slave piston, and a second variable volume fluid chamber formed between said second master and slave pistons.

2. The system according to claim 1, wherein said control valve is a solenoid actuated valve.

3. The system according to claim 1, wherein said control valve is a spool valve.

4. The system according to claim 1, wherein said second slave piston contacts the exhaust valve and said second master piston contacts the exhaust valve train.

5. The system according to claim 1, wherein said second master piston contacts the exhaust valve and said second slave piston contacts the exhaust valve train.

6. The system according to claim 1, where said control valve controls the amount of fluid in said second variable volume fluid chamber in order to selectively modify the openings of said exhaust valve in response to said exhaust valve train.

7. The system according to claim 1, wherein said exhaust valve train comprises a rocker arm.

8. The system according to claim 1, wherein said first slave piston contacts the intake valve and said first master piston contacts the intake valve train.

9. The system according to claim 1, wherein said first master piston contacts the intake valve and said first slave piston contacts the intake valve train.

10. The system according to claim 1, where said control valve controls the amount of fluid in said first variable volume fluid chamber in order to selectively modify the openings of said intake valve in response to said intake valve train.

11. The system according to claim 1, wherein the intake valve train comprises a rocker arm.

12. The system according to claim 1, wherein each of said hydraulic actuators comprises a hydraulic tappet.

13. The system according to claim 12, wherein said hydraulic tappet comprises a master piston and a slave piston, wherein said master piston includes a central bore and said slave piston is slidably disposed inside of said central bore.

14. The system according to claim 13, wherein said slave piston contacts one of said plurality of engine valves and said master piston contacts a valve train.

15. The system according to claim 1, further comprising a means for effectuating engine valve motion upon a loss of hydraulic pressure.

16. The system according to claim 15, wherein said means for effectuating engine valve motion comprises a mechanical link in the hydraulic actuator created when the second variable volume chamber completely collapses and the second master piston contacts the second slave piston directly in order to transfer motion from the exhaust valve train to the exhaust valve.

17. The system according to claim 15, wherein said means for effectuating engine valve motion comprises a mechanical link in the hydraulic actuator created when the first variable volume chamber completely collapses and the first master piston contacts the first slave piston directly in order to transfer motion from the intake valve train to the intake valve.

18. An engine valve actuation system for a cylinder of an internal combustion engine that includes, the cylinder having a first intake valve, a second intake valve, a first exhaust valve and a second exhaust valve, said system comprising:

an intake valve train for providing motion to operate the first and second intake valves;

an exhaust valve train for providing motion to operate the first and second exhaust valves;

a first intake valve actuator that selectively responds to motion of said intake valve train and causes the first intake valve to open;

a second intake valve actuator that selectively responds to motion of said intake valve train and causes the second intake valve to open;

a first exhaust valve actuator that selectively responds to motion of said exhaust valve train and causes the first exhaust valve to open;

a second exhaust valve actuator that selectively responds to motion of said exhaust valve train and causes the second exhaust valve to open;

a first control valve for controlling the operation of said first intake and said first exhaust valve actuators;

a second control valve for controlling the operation of said second intake and said second exhaust valve actuators; and wherein said first intake valve actuator said second intake valve actuator, said first exhaust valve actuator and said second exhaust valve actuator are hydraulic tappets comprising:

a slave piston;

a master piston that includes a central bore; and wherein said slave piston is slidably disposed within the central bore forming a variable volume chamber between said master and slave piston.

19. The system of claim 18, wherein said first and second control valves are solenoid valves.

20. A valve actuation system for an internal combustion engine having a plurality of cylinders, each cylinder having at least one valve, said valve actuation system comprising:

a first valve train for providing motion to operate the at least one valve of a first cylinder of the plurality of cylinders;

a second valve train for providing motion to operate the at least one valve of a second cylinder of the plurality of cylinders;

a first valve actuator that selectively responds to motion of said first valve train to operate the at least one valve of the first cylinder of the plurality of cylinders;

a second valve actuator that selectively responds to motion of said second valve train to operate the at least one valve of the second cylinder of the plurality of cylinders; and a control valve assembly for controlling the operation of said first valve actuator and said second valve actuator in response to motion of said first valve train and said second valve train.

21. The valve actuation system according to claim 20, wherein the at least one valve of the first cylinder is an intake valve, and the at least one valve of the second cylinder is an intake valve.

22. The valve actuation system according to claim 20, wherein the at least one valve of the first cylinder is an exhaust valve, and the at least one valve of the second cylinder is an exhaust valve.

* * * * *